US009809920B2

(12) United States Patent
Ahn et al.

(10) Patent No.: US 9,809,920 B2
(45) Date of Patent: Nov. 7, 2017

(54) FABRIC TREATMENT APPARATUS AND CONTROL METHOD THEREOF

(71) Applicant: LG ELECTRONICS INC., Seoul (KR)

(72) Inventors: Hyukjin Ahn, Seoul (KR); Sungmin Ye, Seoul (KR); Minji Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 243 days.

(21) Appl. No.: 14/568,961

(22) Filed: Dec. 12, 2014

(65) Prior Publication Data

US 2015/0167228 A1 Jun. 18, 2015

(30) Foreign Application Priority Data

Dec. 12, 2013 (KR) ..... 10-2013-0154956

(51) Int. Cl.

| | |
|---|---|
| ***D06F 39/00*** | (2006.01) |
| ***D06F 33/02*** | (2006.01) |
| ***D06F 39/04*** | (2006.01) |
| ***D06F 87/00*** | (2006.01) |

(52) U.S. Cl.

CPC ..... *D06F 39/008* (2013.01); *D06F 33/02* (2013.01); *D06F 39/04* (2013.01); *D06F 39/045* (2013.01); *D06F 87/00* (2013.01); *D06F 2202/04* (2013.01); *D06F 2204/086* (2013.01); *D06F 2212/02* (2013.01)

(58) Field of Classification Search

CPC ..... D06F 39/008; D06F 39/04; D06F 39/045; D06F 33/02; D06F 2202/04; D06F 2202/086; D06F 2212/02

See application file for complete search history.

(56) References Cited

U.S. PATENT DOCUMENTS

| | | | | |
|---|---|---|---|---|
| 2007/0283505 | A1 | 12/2007 | Wong et al. | |
| 2008/0313920 | A1 | 12/2008 | Finke et al. | |
| 2009/0056035 | A1* | 3/2009 | Herkle | D06F 39/008 8/149.3 |
| 2011/0138864 | A1* | 6/2011 | Ahn | D06F 25/00 68/5 C |
| 2011/0154866 | A1* | 6/2011 | Lee | D06F 39/008 68/5 C |

FOREIGN PATENT DOCUMENTS

| | | | |
|---|---|---|---|
| CN | 103243523 | A | 8/2013 |
| EP | 1889966 | A2 | 2/2008 |
| EP | 2006432 | A2 | 12/2008 |

* cited by examiner

*Primary Examiner* — Joseph L Perrin

(74) *Attorney, Agent, or Firm* — Dentons US LLP

(57) ABSTRACT

A fabric treatment apparatus including a steam spray device for heating water to generate steam and for spraying the generated steam into a space in which fabric is received and a water supply valve for adjusting flow of water supplied to the steam spray device to generate steam. A control method of the fabric treatment apparatus including controlling the water supply valve to be repeatedly opened and closed according to a first pattern and controlling the water supply valve to be repeatedly opened and closed according to a second pattern, the second pattern supplying a larger amount of water than in the first pattern for the same time period.

12 Claims, 11 Drawing Sheets

FABRIC TREATMENT APPARATUS AND CONTROL METHOD THEREOF

CROSS-REFERENCE TO RELATED APPLICATION

This application claims priority under 35 U.S.C. §119 to Korean Application No. 10-2013-0154956, filed Dec. 12, 2013, the subject matter of which is hereby incorporated by reference.

BACKGROUND

1. Field

The present disclosure relates to a fabric treatment apparatus and a control method thereof.

2. Background

A steam spray device is a device that applies heat to water to generate steam and sprays the generated steam. A conventional steam spray device is configured to have a structure in which water contained in a predetermined container is heated to generate steam and the generated steam is fed to a nozzle along a hose connected to the container such that the steam is sprayed from the nozzle.

In the above structure, however, a predetermined amount of water is heated in a state in which the water is stored in the container, i.e. flow of the water in the container is stopped, until steam is generated. Consequently, it is necessary to heat the water in the container to a temperature of 100 ° C. or higher, which is a temperature necessary to generate steam. As a result, it takes a long time until steam is generated. Additionally, the container, in which the steam is generated, and the nozzle are connected to each other via the hose. The temperature of the generated steam is lowered during movement of the steam along the hose resulting in condensed water being discharged through the nozzle.

SUMMARY

One object is to provide a fabric treatment apparatus and a control method thereof that are capable of preventing overheating of a steam spray device.

Another object is to provide a fabric treatment apparatus and a control method thereof that are capable of adjusting the amount of steam generated by a steam spray device using a water supply valve.

Yet another object is to provide a fabric treatment apparatus and a control method thereof that are capable of diversifying a steam spray pattern using a water supply valve.

Still another object is to provide a fabric treatment apparatus and a control method thereof that are capable of preventing condensed water from being discharged from a nozzle.

It should be noted that the above-mentioned objects are not limiting, and other unmentioned objects will be clearly understood by those skilled in the art from the following description.

In accordance with an embodiment of the present invention, the above and other objects can be accomplished by the provision of a control method of a fabric treatment apparatus including a steam spray device and a water supply valve, the control method including a step (a) of controlling, by a controller, the water supply valve to be repeatedly opened and closed according to a first pattern and a step (b) of controlling, by the controller, the water supply valve to be repeatedly opened and closed according to a second pattern, wherein the second pattern supplies a larger amount of water than in the first pattern for the same time period.

A second pattern duty cycle of the water supply valve may be greater than a first pattern duty cycle of the water supply valve. The second pattern open time of the water supply valve may be longer than the first pattern open time of the water supply valve.

The control method may further include sensing, by a temperature sensing unit, a temperature in the steam spray device during execution of the step (a), wherein the step (b) may be performed when the sensed temperature reaches a predetermined upper limit of temperature.

The steam spray device may include a steam generation heater for heating water, the control method may further include a step (c) of operating, by the controller, the steam generation heater in a state in which the water supply valve is closed (c), and the step (a) may be performed after the step (c).

The control method may further include sensing, by a temperature sensing unit, a temperature in the steam spray device during execution of the step (c), wherein the step (a) may be performed when the sensed temperature is raised to a predetermined lower limit of temperature.

The lower limit of temperature may be equal to or higher than a temperature necessary for water to be phase-changed into steam.

The steam spray device may include a steam generation heater for heating water, and the control method may further include sensing, by a temperature sensing unit, a temperature in the steam spray device in which the steam is generated during execution of the step (a) and stopping, by a controller, operation of the steam generation heater when the sensed temperature reaches a predetermined upper limit of temperature. The control method may further include resuming, by the controller, the operation of the steam generation heater when the temperature in the steam spray device is lowered to a predetermined lower limit of temperature in a state in which the operation of the steam generation heater is stopped. The control method may further include accumulating, by the controller, the number of times of operating the steam generation heater, wherein the step (b) is carried out when the accumulated number of times reaches a predetermined value.

In accordance with another aspect of the present invention, there is provided a fabric treatment apparatus including a fabric receiving unit having a space for receiving fabric formed therein, a steam spray device for heating water to generate steam and spraying the generated steam into the fabric receiving unit, a water supply valve for adjusting water flow supplied to the steam spray device, and a controller for controlling the water supply valve to be repeatedly opened and closed according to a first pattern and then controlling the water supply valve to be repeatedly opened and closed according to a second pattern, wherein the second pattern supplies a larger amount of water than in the first pattern for the same time period.

A second pattern duty cycle of the water supply valve may be greater than a first pattern duty cycle of the water supply valve. The second pattern open time of the water supply valve may be longer than the first pattern open time of the water supply valve.

The steam spray device may include a flow channel forming unit having a flow channel, along which water introduced through the water supply valve flows, formed therein, a steam generation heater for heating the water flowing along the flow channel forming unit to generate steam, and a nozzle for spraying the steam generated in the flow channel forming unit into the fabric receiving unit, and the fabric treatment apparatus may further include a temperature sensing unit for sensing a temperature in the flow channel forming unit.

The controller may control the water supply valve to be operated according to the second pattern when the temperature sensed by the temperature sensing unit reaches a predetermined upper limit of temperature. The controller may control the water supply valve to be operated according to the first pattern when the temperature sensed by the temperature sensing unit is raised to a predetermined lower limit of temperature after the steam generation heater is controlled to be operated in a state in which the water supply valve is closed. The lower limit of temperature may be equal to or higher than a temperature necessary for water to be phase-changed into steam.

The controller may control operation of the steam generation heater to be stopped when the temperature sensed by the temperature sensing unit reaches a predetermined upper limit of temperature while the water supply valve is operated according to the first pattern. The controller may control the operation of the steam generation heater to be resumed when the temperature in the steam spray device is lowered to a predetermined lower limit of temperature in a state in which the operation of the steam generation heater is stopped. The controller may accumulate the number of times of operating the steam generation heater and control the water supply valve to be operated according to the second pattern when the accumulated number of times reaches a predetermined value.

BRIEF DESCRIPTION OF THE DRAWINGS

Embodiments will be described in detail with reference to the following drawings in which like reference numerals refer to like elements, and wherein.

DETAILED DESCRIPTION

Advantages and features of the invention and methods for achieving the same may become apparent upon referring to the embodiments described later in detail together with attached drawings. However, embodiments are not strictly limited as disclosed hereinafter, but may be embodied in different modes. The same reference numbers may refer to the same elements throughout the specification.

In the following description, a fabric treatment apparatus is an apparatus that supplies hot air or cold air into a predetermined space, in which fabric is received, to dry the fabric. The fabric treatment apparatus includes a general dryer having a rotatable drum and a blower for blowing air into the drum, a combination washer/dryer having a drying function as well as a washing function to perform washing through the supply of water, and a refresher for unwrinkling fabric received in a cabinet and anti-bacterially treating the fabric. Hereinafter, a general dryer for supplying drying air to fabric will be described as an example of the fabric treatment apparatus for the convenience of description.

Figure 1:
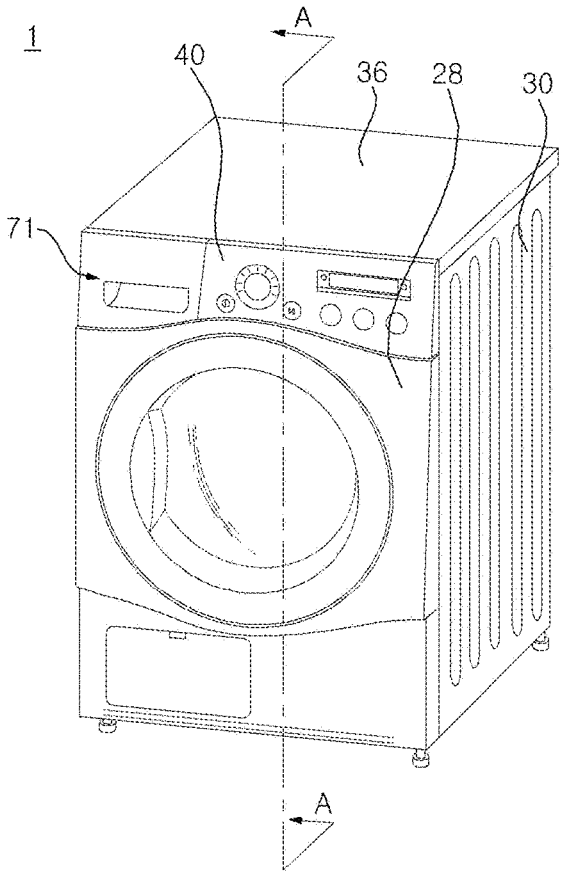
FIG. 1 is a perspective view showing a fabric treatment apparatus according to an embodiment of the present invention.
Figure 2:
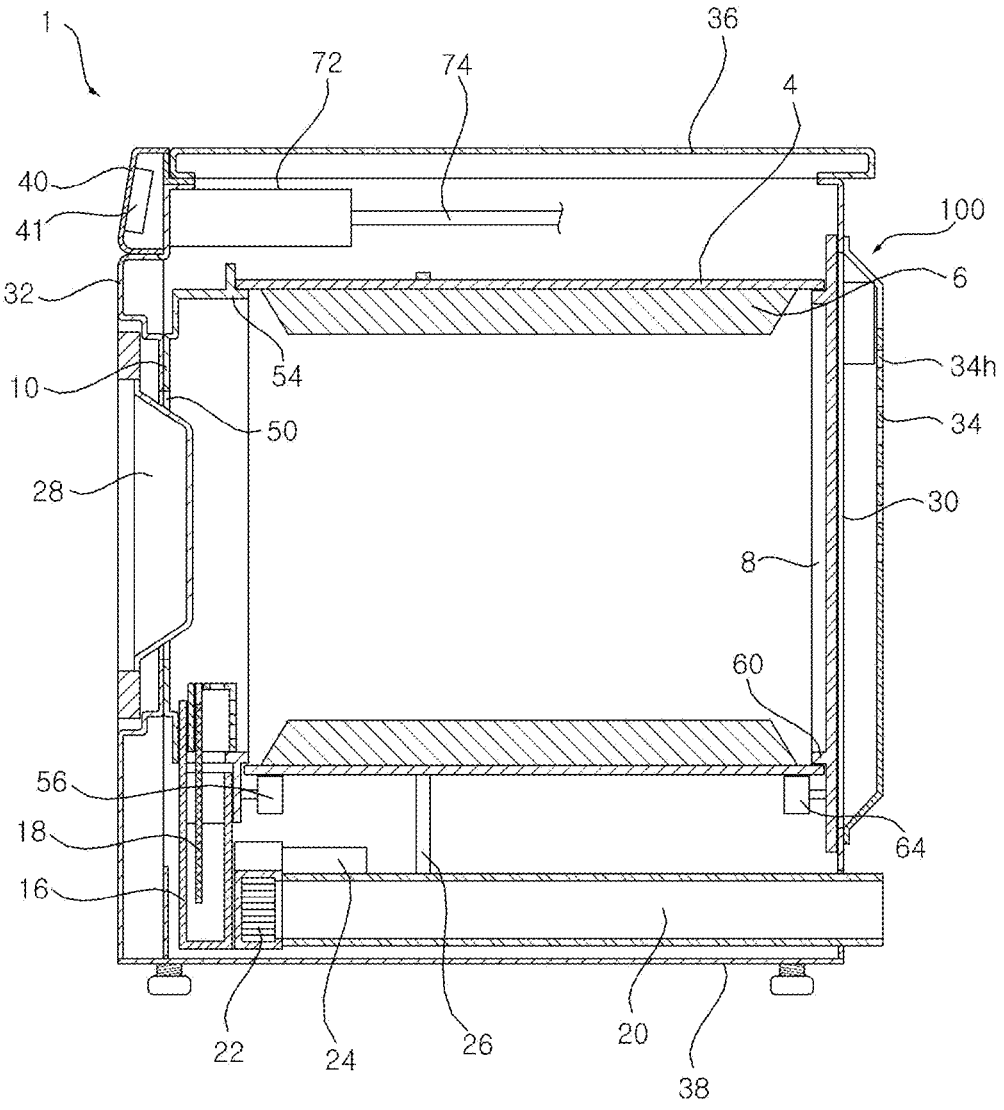
FIG. 2 is a sectional view taken along line A-A of FIG. 1.
Figure 3:
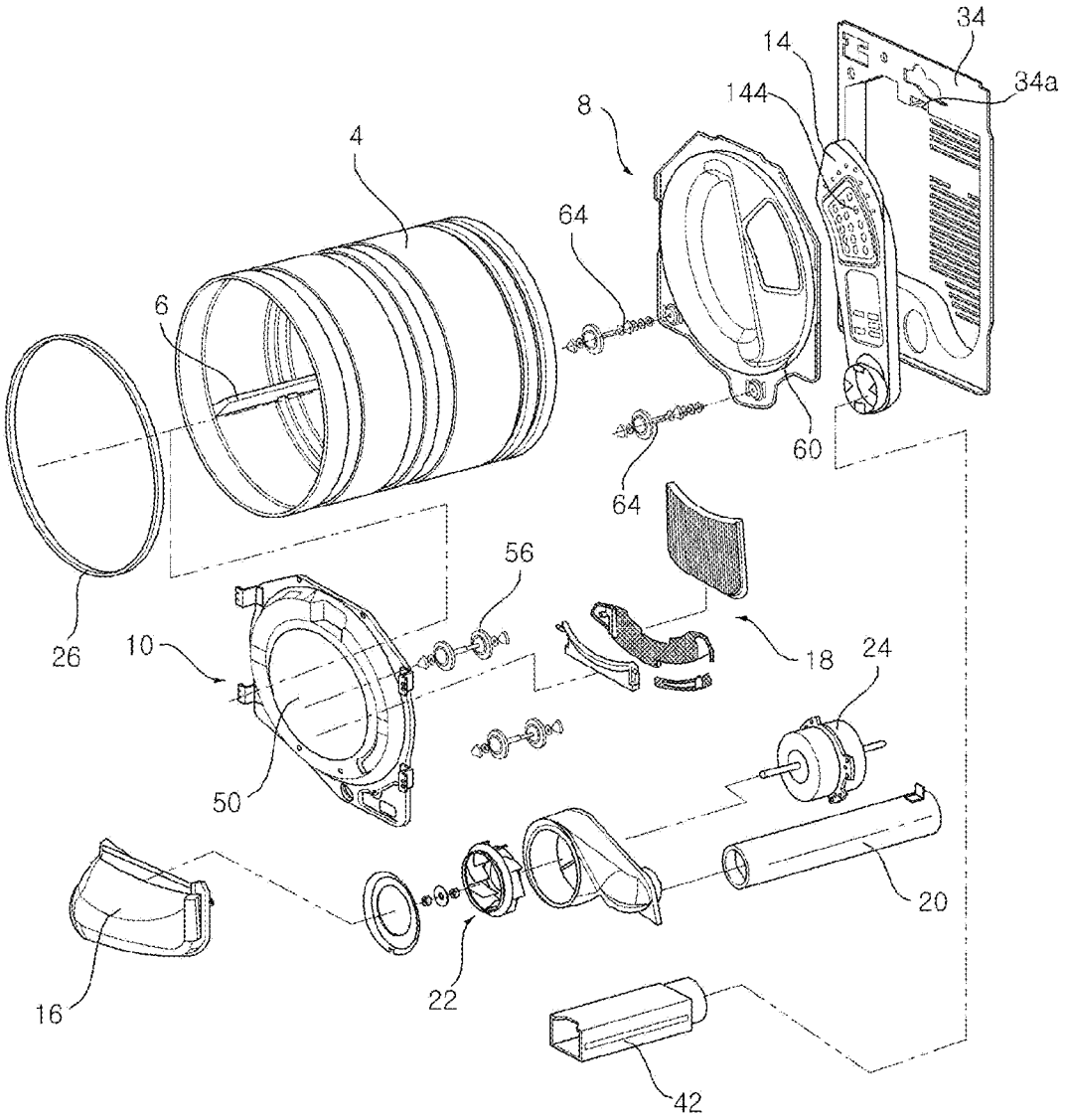
FIG. 3 is an exploded perspective view showing the fabric treatment apparatus according to the embodiment of the present invention.

FIG. 1 is a perspective view showing a fabric treatment apparatus according to an embodiment of the present invention. FIG. 2 is a sectional view taken along line A-A of FIG. 1. FIG. 3 is an exploded perspective view showing the fabric treatment apparatus according to the embodiment of the present invention.

Referring to FIGS. 1 to 3, a fabric treatment apparatus 1 according to an embodiment of the present invention includes a casing forming the external appearance of the fabric treatment apparatus and a fabric receiving unit provided in the casing for forming a space in which fabric is received. The fabric receiving unit may include rotatable drum 4. Lifters 6 are provided at the inner circumference of drum 4 such that the fabric can be lifted and then dropped during the rotation of drum 4.

The casing, may include a cabinet 30, a cabinet cover 32 mounted at the front of cabinet 30, the cabinet cover 32 being provided with a fabric introduction port, at the middle thereof, a control panel 40 provided at the upper side of cabinet cover 32, a back panel 34 mounted at the rear of cabinet 30, the back panel 34 having at least one through-hole **34*h*, through which air flows into and out of the cabinet 30, a top plate 36 for covering the upper part of cabinet 30, and a base 38 mounted at the lower part of cabinet 30. A door 28 for opening and closing the fabric introduction port may be hingedly connected to cabinet cover 32**.

Control panel 40 may be provided at the front of the fabric treatment apparatus 1 and include an input unit, such as a button and/or dial, for allowing a user to input various control commands related to operation of fabric treatment apparatus 1 and a display unit, such as a liquid crystal display (LCD) and/or a light emitting diode (LED), for visually displaying operation status of fabric treatment apparatus 1. Control panel 40 may be provided at the rear of the fabric treatment apparatus 1 and includes a controller 41 for controlling overall operation of fabric treatment apparatus 1. The controller 41 may include hardware (e.g., a microprocessor).

According to some embodiments, cabinet 30 may be provided with a water receiving unit 72 for supplying water to a steam spray device 100. A drawer 71 may be supported by cabinet 30 such that drawer 71 can be withdrawn from cabinet 30 and the water receiving unit 72 may be received in drawer 71.

A front supporter 10 and a rear supporter 8 are provided at the front part and the rear part of the casing, respectively. The front and the rear of drum 4 are supported by front supporter 10 and rear supporter 8, respectively.

Front supporter 10 includes an opening 50 provided at the middle of front support 10 and in communication with the fabric introduction part. Front supporter 10 is further provided at the rear thereof with a ring-shaped front support protrusion 54 for supporting a front end of drum 4. In addition, front supporter 10 is provided at the lower part thereof with a front guide roller 56 which is rotatable. The inner circumference of the front end of drum 4 is supported by front support protrusion 54 and the outer circumference of the front end of drum 4 is supported by front guide roller 56.

Rear supporter 8 is provided at the front thereof with a ring-shaped rear support protrusion 60 for supporting a rear end of drum 4 and rear supporter 8 is provided at the lower part of the front thereof with a rear guide roller 64 which is rotatable. The inner circumference of the rear end of drum 4 is supported by rear support protrusion 60 and the outer circumference of the rear end of drum 4 is supported by the rear guide roller 64.

Drum 4 is provided at a lower side thereof with a drying heater 42 for heating air. A drying duct 14 is provided between rear supporter 8 and drying heater 42 such that rear supporter 8 and drying heater 42 communicate with each other via drying duct 14 for supplying the air heated by drying heater 42 into drum 4. Front supporter 10 is provided with a lint duct 16 such that lint duct 16 communicates with front supporter 10 allowing the air having passed through drum 4 to be introduced thereinto.

Drying duct 14 is provided with a plurality of through holes 144, through which air is discharged into drum 4. Air flows in drum 4 via lint duct 16, a blower 22, and an exhaust duct 20 due to the blowing force generated by blower 22. Particularly, in the flowing process of the air, the air heated by drying heater 42 flows along drying duct 14 and is then discharged into drum 4 through the through holes 144.

Additionally, the air introduced into lint duct 16 is purified by a filter 18. The casing is provided at the rear thereof with an exhaust duct 20 for guiding the air from lint duct 16 to the outside of the casing.

Blower 22 is connected between exhaust duct 20 and lint duct 16. Fabric treatment apparatus 1 further includes a motor 24 for generating the driving force of blower 22. A transmission belt 26 is interlocked with the motor 24 for transmitting a driving force of motor 24 to rotate drum 4.

Figure 4:
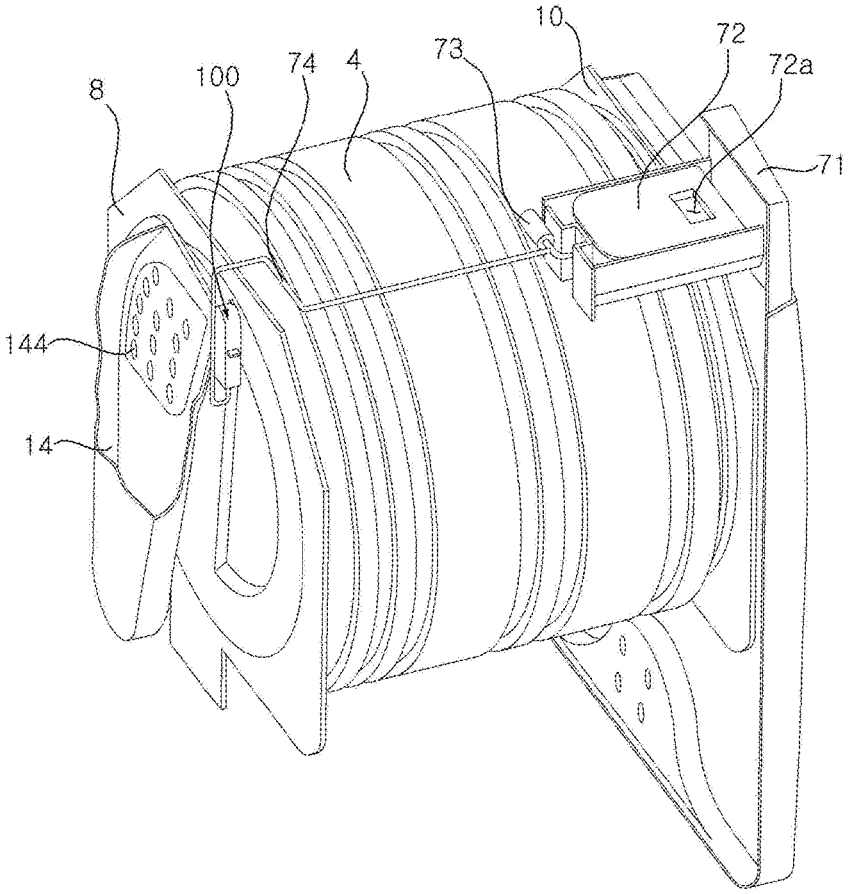
FIG. 4 is a perspective view showing the interior of the fabric treatment apparatus including a steam spray device according to an embodiment of the present invention.
Figure 5A:
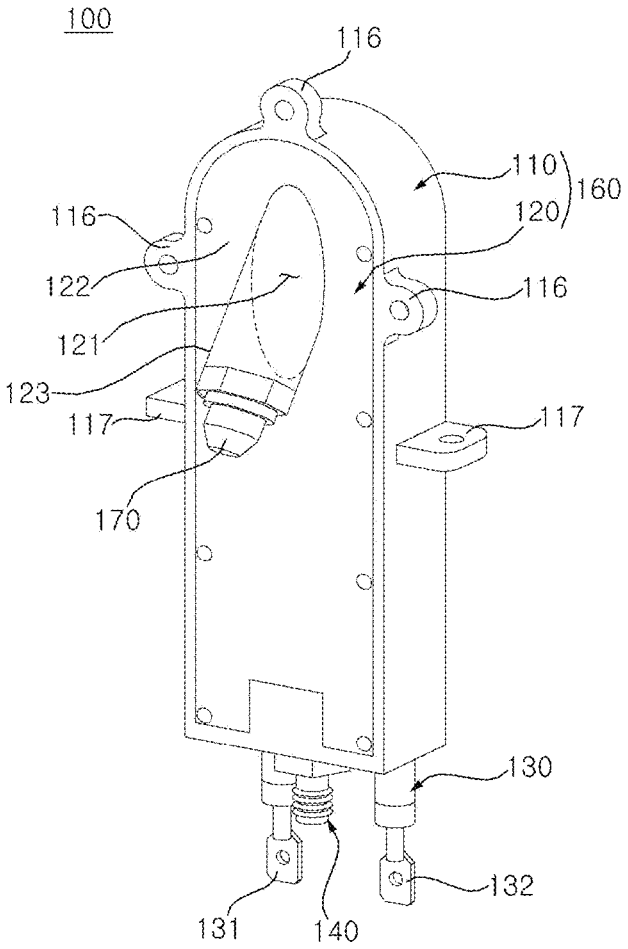
FIG. 5A is a perspective view showing the steam spray device according to an embodiment of the present invention.
Figure 5B:
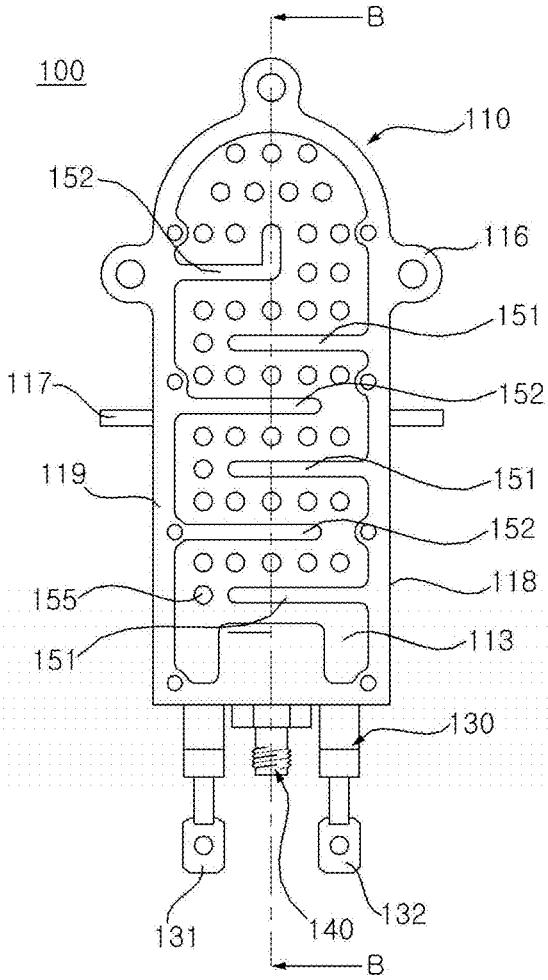
FIG. 5B is a view showing a flow channel forming unit of the steam spray device according to an embodiment of the present invention.
Figure 5C:
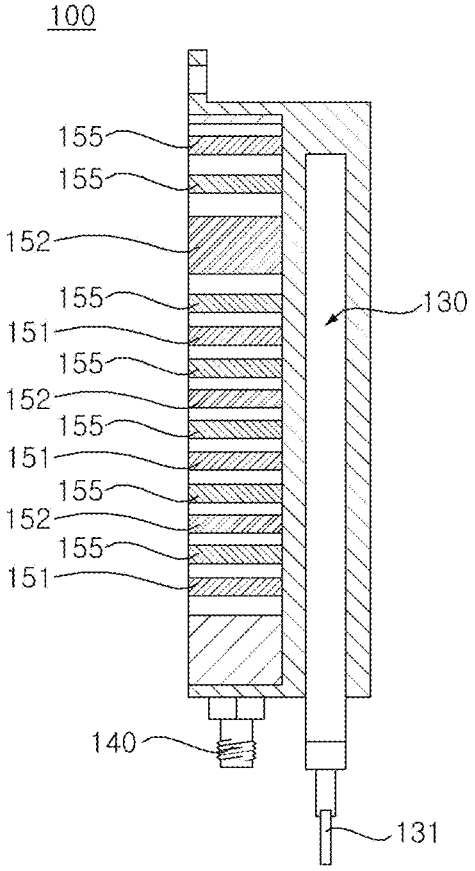
FIG. 5C is a sectional view taken along line B-B of FIG. 5B.

FIG. 4 is a perspective view showing the interior of the fabric treatment apparatus including the steam spray device. FIG. 5A is a perspective view showing the steam spray device. FIG. 5B is a view showing a flow channel forming unit of the steam spray device. FIG. 5C is a sectional view taken along line B-B of FIG. 5B.

Referring to FIGS. 4 and 5A-5C, the steam spray device 100 is a device for spraying water into drum 4. Steam spray device 100 includes a flow channel forming unit 160 having a flow channel, along which water introduced through an introduction port 140 is guided to a discharge port 121, formed therein, a steam generation heater 130 for applying heat to the water flowing along the flow channel formed in flow channel forming unit 160, and a nozzle 170 for spraying steam generated by a heating operation of steam generation heater 130 at a predetermined pressure.

In one embodiment, water receiving unit 72 is provided. Alternatively, flow channel forming unit 160 may directly receive water from an external water source, such as a tap. For example, a water supply hose connected to the external water source may be connected to introduction port 140, a valve for regulating the supply of water may be further provided between introduction port 140 and the water supply hose, and a filter for filtering foreign matter from the supplied water may be further provided.

In this embodiment, introduction port 140 is connected to water receiving unit 72 via a water supply pipe 74, and a pump 73 is provided for forcibly feeding water from the water receiving unit 72 to flow channel forming unit 160.

Flow channel forming unit 160 and nozzle 170 may be integrally coupled to each other. Integral coupling between flow channel forming unit 160 and nozzle 170 includes a case in which flow channel forming unit 160 and nozzle 170 are formed as separate members and are then coupled to each other to constitute a single unit or module, and a case in which flow channel forming unit 160 and nozzle 170 are formed as a single member by injection molding. Regardless of the coupling method, the position of nozzle 170 may be decided based on the fixed position of flow channel forming unit 160.

In a conventional structure in which water contained in a predetermined container is heated to generate steam and the generated steam is fed to a nozzle along a hose, the stream is condensed during flow along the hose. As a result, the condensed water is sprayed through the nozzle, wetting the previously dried articles. Conversely, in this embodiment of the present invention water is heated to generate steam while flowing along flow channel forming unit 160, and the steam is sprayed through nozzle 170 integrally formed at flow channel forming unit 160. Consequently, it is possible to fundamentally prevent the occurrence of a phenomenon in which the steam generated in flow channel forming unit 160 is condensed while being supplied to nozzle 170.

Water receiving unit 72 is provided in drawer 71. A user may withdraw drawer 71 and supply water into water receiving unit 72 through an introduction port 72*a* formed at water receiving unit 72. In particular, for a fabric treatment apparatus miniaturized in consideration of mobility, the structure in which water is supplied through water receiving unit 72 is more advantageous than the structure in which water is supplied through the external water source.

Flow channel forming unit 160 may include a flow channel body 110 having a flow channel, along which water is guided from introduction port 140 to discharge port 121, formed therein, the flow channel body 110 being open at the upper part thereof, and a cover 120 for covering the open upper part of flow channel body 110. According to some embodiments, flow channel body 110 and cover 120 may be integrally formed. Introduction port 140, which is connected to water supply pipe 74, is formed at flow channel body 110. Consequently, water is introduced into flow channel body 110 through introduction port 140.

Steam generation heater 130 is provided to heat water introduced into flow channel body 110, to generate steam. Steam generation heater 130 may be provided in a flow channel, along which water flows, in an exposed state. In this embodiment, steam generation heater 130 is embedded in a bottom 113 of flow channel body 110. Since steam generation heater 130 is not directly exposed to water, it is not necessary to provide an additional insulation structure for insulating steam generation heater 130. Flow channel body 110 may be made of a thermally conductive material, such as aluminum, such that heat can be easily transferred from steam generation heater 130 to flow channel body 110.

Steam generation heater 130 may include two terminals 131 and 132 for supplying power. The terminals protrude outwardly from flow channel body 110 so that the terminals may be electrically connected to a power source.

Flow channel body 110 has a predetermined space, along which water moves, formed therein. A plurality of flow channel forming ribs 151 and 152 are formed at the bottom 113 of flow channel body 110 and protrude away from the bottom 113. The flow channel forming ribs 151 and 152 define water moving channels. The flow channel forming ribs 151 and 152 also extend from sides 118 and 119, respectively, of the flow channel body 110.

Flow channel forming ribs 151 and 152 include first flow channel forming ribs 151 extending from a right side 118 of the flow channel body 110 and second flow channel forming ribs 152 extending from a left side 119 of the flow channel body 110. The first flow channel forming ribs 151 and the second flow channel forming ribs 152 are alternately arranged between introduction port 140 and nozzle 170.

An end of each of the first flow channel forming ribs 151 is spaced apart from the left side 119 of the flow channel body 110 by a predetermined distance. In the same manner, an end of each of the second flow channel forming ribs 152 is spaced apart from the right side 118 of the flow channel body 110 by a predetermined distance. Water, supplied through introduction port 140, is guided along a flow channel defined between flow channel forming ribs 151 and 152. The movement direction of the water is alternately changed during movement of the water toward nozzle 170.

Cover 120 covers flow channel body 110. Cover 120 may be integrally formed at flow channel body 110. Alternatively, cover 120 may be coupled to flow channel body 110 by fastening members, such as screws or bolts. At this time, airtightness may be achieved between cover 120 and flow channel body 110 to prevent leakage of steam generated in flow channel body 110.

Cover 120 may include a plate body 122 for covering flow channel body 110 and a guide pipe 123 extending from a discharge port 121 formed at plate body 122 for guiding steam generated in flow channel body 110 to nozzle 170. Nozzle 170 is coupled to an end of guide pipe 123.

Meanwhile, a plurality of fastening parts 116 and 117 may be formed at flow channel body 110. Each of the fastening parts is provided with a fastening hole, through which a fastening member for fixing the flow channel body 110 is fastened. It is possible to form the fastening holes such that the fastening holes have different opening directions in consideration of various installation structures. In this embodiment, the opening direction of the fastening holes formed at the first fastening parts 116 is different from the opening direction of the fastening holes formed at the second fastening parts 117.

Meanwhile, a plurality of heat transfer protrusions 155 may be formed between first flow channel forming ribs 151 and second flow channel forming ribs 152 such that heat transfer protrusions 155 protrude from the bottom 113 of flow channel body 110. The heat transfer protrusions 155 are disposed such that the heat transfer protrusions 155 are spaced apart from each other by a predetermined distance. When heat is emitted from steam generation heater 130, bottom 113 of the flow channel body 110 is heated, and the flow channel forming ribs 151 and 152 and heat transfer protrusions 155 are also heated. In this structure, the emission area of heat transferred from steam generation heater 130 is large. Consequently, water moving along the flow channel defined between flow channel forming ribs 151 and 152 is phase-changed into steam at a high speed.

When the flow channel body 110, particularly bottom 113, is made of a thermally conductive material, a heating effect achieved by the flow channel forming ribs 151 and 152 and heat transfer protrusions 155 is improved.

In the structure in which the movement direction of the water is alternately changed along the flow channel defined between flow channel forming ribs 151 and 152 as described above, the movement distance of the water is increased with the result that sufficient heat can be applied to the water moving along the flow channel. Furthermore, the water can be sufficiently heated until the water reaches nozzle 170 in consideration of the heating effect achieved by heat transfer protrusions 155. In comparison with a case in which water necessary to generate steam is collected in a predetermined space and the water is heated to generate steam, this embodiment has an advantage in that heat is applied to moving water and thus a phase change of the water is almost immediately performed, whereby it is possible to reduce the time period necessary to spray steam as compared with the conventional art.

Additionally, since the water is heated during movement of the water along the flow channel formed in flow channel forming unit 160, pressure applied to the water is gradually increased from an upper stream to a lower stream with the result being that high-pressure steam may be sprayed through nozzle 170. In particular, pressure generated by movement of the water from introduction port 140 to discharge port 121 as well as pressure increased by the steam is applied to discharge port 121. Consequently, the spray pressure of nozzle 170 is further increased.

During spraying of the steam through nozzle 170, the temperature at discharge port 121 or the inlet of nozzle 170 is about 70 ° C. or less and the temperature in drum 4 is maintained at 30 ° C. to 40 ° C. If the temperature of the steam applied to fabric is too high, the fabric may be directly damaged and, in addition, secondary contamination may occur due to denaturalization of stains on the fabric. In this embodiment, on the other hand, the temperature in drum 4 is maintained at 30 ° C. to 40 ° C. although the steam is sprayed through nozzle 170 at a predetermined pressure or higher with the result that it is possible to prevent damage to the fabric.

Figure 6:
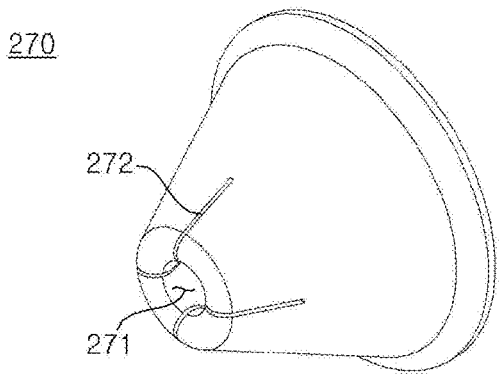
FIG. 6 is a graph showing the spray pressure of a nozzle based on a spray diameter of the nozzle according to an embodiment of the present invention.

The spray pressure of nozzle 170 is closely related to the diameter of a spray port. Referring to FIG. 6, the diameter of the spray port of nozzle 170 may be changed in a state in which other conditions are not changed to measure the spray pressure of nozzle 170. In a case in which the diameter of the spray port is greater than 1.5 mm, water sprayed through nozzle 170 does not strike fabric with sufficient intensity or does not reach the fabric at all. In a case in which the diameter of the spray port is less than 1 mm, on the other hand, the amount of water sprayed through nozzle 170 is insufficient to treat the fabric. Additionally, the less the diameter of the spray port is, the more easily the spray port may be clogged due to scale. Consequently, the diameter of the spray port of nozzle 170 may be about 1.5 to 2 mm in consideration of various effects. At this time, nozzle 170 may spray 70 to 120 cc of water per minute.

Nozzle 270 may have a spray port 271. The nozzle 270 may have an incision part 272 formed about spray port 271 in a cross shape. The incision part 272 increases the diameter of spray port 271. Scale moving in flow channel forming unit 160 may be formed in a thin plate shape. Consequently, the scale may be discharged through a gap formed in incision part 272.

Additionally, since the water moves along the narrow flow channel defined between flow channel forming ribs 151 and 152 and the water continuously absorbs heat during the movement of the water, the water in the lower stream in the direction in which the water moves from introduction port 140 to the nozzle has a long time for absorbing heat and, therefore, the change in phase of the water can be easily achieved. The water in the upper stream is rapidly heated by bottom 113 of the of the flow channel body 110 to generate steam. Furthermore, water pressure generated due to the movement of the water is applied with the result that the water becomes a high-temperature and high-pressure state and, therefore, high pressure is applied from the upper stream to the lower stream. Consequently, the steam finally sprayed through nozzle 170 may reach the fabric in drum 4 in a state in which the steam is maintained at a very high pressure.

That is, steam spray device 100 according to the embodiment of the present invention generates and sprays steam within a short period of time. Consequently, it is possible to reduce time necessary to perform a steam spray process, thereby reducing power consumption, and to spray high-pressure steam.

Figure 7:
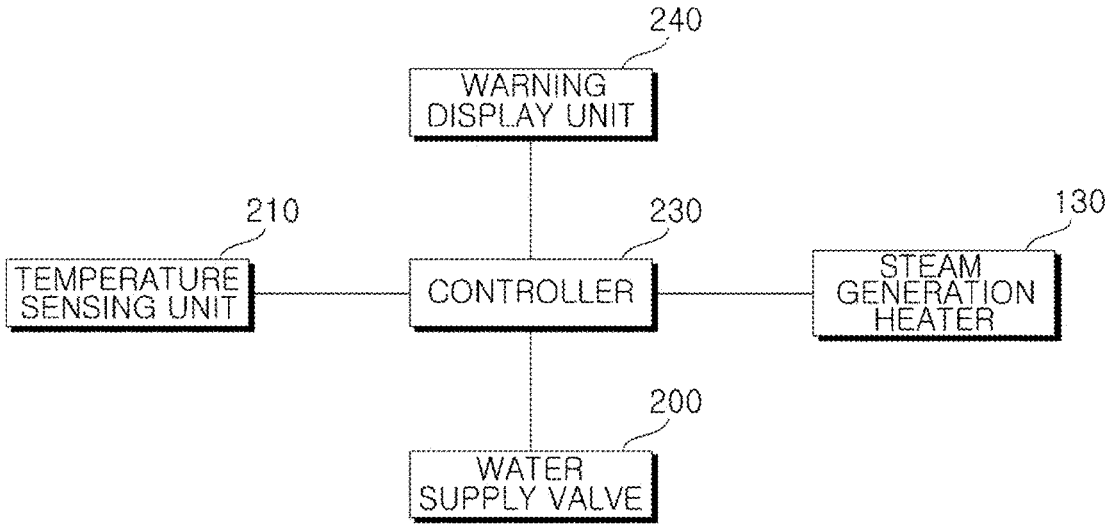
FIG. 7 is a block diagram showing a relationship between a controller and peripheral devices according to an embodiment of the present invention.

FIG. 7 is a block diagram showing a relationship between a controller and peripheral devices. Referring to FIGS. 1 to 7, fabric treatment apparatus 1 according to an embodiment of the present invention includes a fabric receiving unit 4 having a fabric receiving space formed therein, a nozzle 170 disposed in fabric receiving unit 4, a steam generation heater 130 for converting electric energy into thermal energy, a flow channel forming unit 160 for generating steam using the thermal energy received from steam generation heater 130 and forming a flow channel from an introduction port 140, through which water is introduced, to a discharge port 121, through which steam is discharged, and a water supply valve 200 for adjusting the flow of water supplied to introduction port 140.

Water supply valve 200 may regulate water introduced into introduction port 140 of flow channel forming unit 160. As previously described, introduction port 140 may directly receive water from an external water source (for example, a tap) through the water supply hose. When the water is supplied from an external water source at uniform water pressure, the amount of water introduced into introduction port 140 is proportional to an open time of water supply valve 200.

Alternatively, pump 73 may be operated to supply water from water receiving unit 72 to introduction port 140 through water supply pipe 74 as in one embodiment. As long as a mass flow rate of the water forcibly fed by pump 73 is uniform, the amount of water introduced into introduction port 140 is proportional to the open time of water supply valve 200.

When steam generation heater 130 is continuously operated in a state in which water supply valve 200 is closed, flow of water from introduction port 140 to discharge port 121 is stopped and, therefore, discharge pressure of steam discharged through the discharge port 121 is lowered. As a result, a mass flow rate of the steam sprayed through nozzle 170 is also reduced. That is, opening of water supply valve 200 functions to supply water to flow channel forming unit 160 and, in addition, to spray steam through nozzle 170 at high pressure.

Meanwhile, water supply valve 200 may be a valve, an opening degree of which can be adjusted. In this case, it is possible to control a mass flow rate of water supplied to introduction port 140 by adjusting the opening degree of the water supply valve 200.

Water supply valve 200 may be configured to have a structure that is capable of supplying an appropriate amount of water such that the water is heated by steam generation heater 130 into steam while flowing from introduction port 140 to discharge port 121 along the flow channel formed in flow channel forming unit 160. In this structure, water can be rapidly phase-changed into steam during flow of the water.

Water supply valve 200 may be controlled to be repeatedly opened and closed. In this case, the amount of water supplied into flow channel forming unit 160 for a predetermined time is proportional to a ratio of an open time of water supply valve 200 to an opening and closing cycle of water supply valve 200 (or a ratio of an open time to a close time of water supply valve 200 within one cycle).

Additionally, a mass flow rate of steam sprayed through the nozzle may be changed based on a ratio of an open time of water supply valve 200 (time during which the water supply valve 200 remains open within one cycle) to an opening and closing cycle of water supply valve 200 (a time interval between one opening and another opening of the water supply valve 200).

The temperature in flow channel forming unit 160 is changed due to causes, such as evaporation heat which water absorbs from the surroundings during phase-change of the water into steam and latent heat of the water. In particular, since water is supplied periodically through water supply valve 200, the temperature in the flow channel forming unit 160 is repeatedly increased and decreased (see FIG. 9).

Meanwhile, since water is supplied into flow channel forming unit 160 through repeated opening and closing of water supply valve 200, steam may be discontinuously sprayed from nozzle 170. However, it is possible that steam may be continuously sprayed from nozzle 170. For example, in a case in which an open time and a close time (time during which water supply valve 200 remains closed within one cycle) of water supply valve 200 are appropriately adjusted, it is possible to continuously spray steam through nozzle 170 although water is discontinuously supplied through water supply valve 200.

The temperature in flow channel forming unit 160 may be changed based on a mass flow rate of water introduced through introduction port 140. For example, the decrease in mass flow rate of water introduced through introduction port 140 may increase the temperature in flow channel forming unit 160. On the other hand, the increase in mass flow rate of water introduced through introduction port 140 may decrease the temperature in flow channel forming unit 160.

It is necessary to appropriately adjust a mass flow rate of water introduced through introduction port 140 and, in addition, to adjust the temperature in flow channel forming unit 160 within an appropriate range such that an appropriate mass flow rate of steam can be continuously sprayed through nozzle 170.

In order to adjust the temperature in flow channel forming unit 160 within an appropriate range, the supply of water through water supply valve 200 may be controlled based on the temperature in flow channel forming unit 160. To this end, fabric treatment apparatus 1 may further include a temperature sensing unit 210 for measuring the temperature in the flow channel forming unit 160. In this case, controller 230 may control the operation of water supply valve 200 based on the temperature in flow channel forming unit 160 sensed by temperature sensing unit 210. The controller 230 may be hardware (e.g., a microprocessor). Temperature sensing unit 210 may be provided in flow channel forming unit 160 such that temperature sensing unit 210 does not directly contact water.

Figure 8:
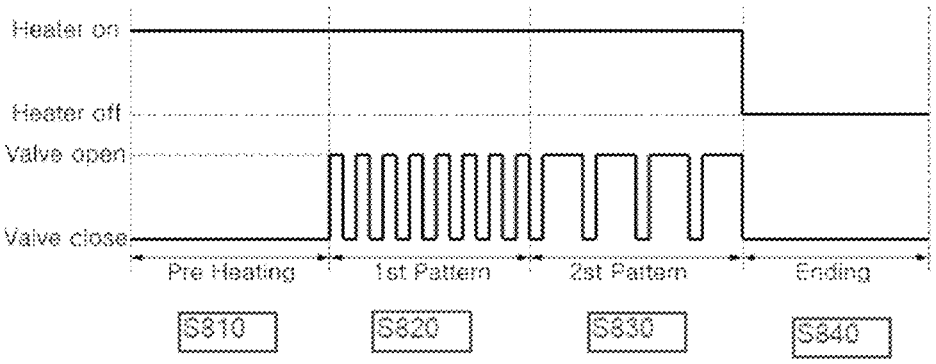
FIG. 8 is a graph briefly showing a method in which a steam generation heater and a water supply valve are controlled by the controller according to an embodiment of the present invention.
Figure 9:
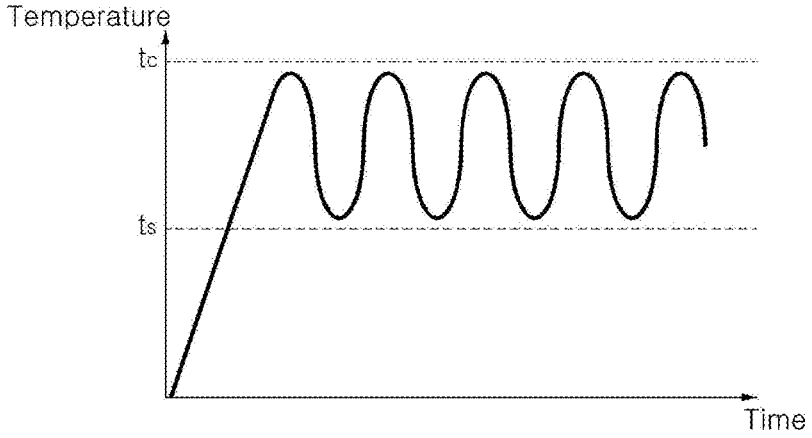
FIG. 9 is a graph showing the change in temperature of the flow channel forming unit between a critical temperature and a steam generation temperature according to an embodiment of the present invention.

FIG. 8 is a graph briefly showing a method in which the steam generation heater and the water supply valve are controlled by the controller. FIG. 9 is a graph showing the change in temperature of flow channel forming unit between a critical temperature and a steam generation temperature.

Referring to FIGS. 8 and 9, when water is periodically (or repeatedly) supplied through water supply valve 200, the temperature in flow channel forming unit 160 may be adjusted between the lower limit of temperature (hereinafter, referred to as a steam generation temperature Ts) and the upper limit of temperature (hereinafter, referred to as a critical temperature Tc) as shown in FIG. 9. The steam generation temperature Ts may be set to the minimum temperature or higher at which steam starts to be generated and the critical temperature Tc may be set in consideration of heat resistance of the apparatus. According to some embodiments, nozzle 170 may be connected to discharge port 121 via a hose. In this case, the critical temperature Tc may be set within a range in which the hose is not melted by heat. The hose may be made of a synthetic resin.

In this embodiment, the steam generation temperature Ts and the critical temperature Tc are obtained through experiments. The steam generation temperature Ts is the temperature in flow channel forming unit 160 when voltage 15% lower than a reference voltage (voltage applied to operate steam generation heater 130) is applied to the steam generation heater 130 under a predetermined condition. The critical temperature Tc is the temperature in the flow channel forming unit 160 when voltage 15% higher than the reference voltage is applied to the steam generation heater 130 under the same condition. However, the present invention is not limited thereto.

When water is supplied into flow channel forming unit 160 to generate steam, controller 230 may control water supply valve 200 to be repeatedly opened and closed in a first pattern and then control water supply valve 200 to be repeatedly opened and closed in a second pattern configured to supply a larger amount of water than in the first pattern for the same time. Steam generation time is increased, as compared with time during which only the steam generation heater 130 is operated without generation of steam, whereby it is possible to prevent an excessive increase of the temperature in the flow channel forming unit 160.

For example, in a case in which a water supply cycle according to the first pattern and a water supply cycle according to the second pattern are the same, the second pattern may be set such that the open time of the water supply valve 200 per cycle is longer than in the first pattern. The first pattern may be a pattern in which water supply valve 200 is open for 2 seconds and closed for 3 seconds, which is repeated. The second pattern may be a pattern in which the water supply valve 200 is open for 3 seconds and closed for 2 seconds, which is repeated. Meanwhile, a larger number of patterns may be provided. For example, after water supply valve 200 is operated according to the second pattern, the operation of water supply valve 200 may be controlled according to a third pattern (for example, water supply valve 200 is open for 4 seconds and closed for 1 second) in which an open time of water supply valve 200 per cycle is set to be longer than in the second pattern.

On the other hand, in a case in which the water supply cycle according to the first pattern and the water supply cycle according to the second pattern are different from each other, the first pattern and the second pattern may be set such that a ratio of the open time to one water supply cycle in the second pattern is greater than a ratio of the open time to one water supply cycle in the first pattern.

The basis on which an operating pattern of water supply valve 200 switches from the first pattern to the second pattern such that water supply valve 200 is operated according to the first pattern and then operated according to the second pattern may be the temperature in the flow channel forming unit 160. In this case, when the temperature sensed by temperature sensing unit 210 is equal to or greater than the critical temperature Tc, controller 230 may control the operating pattern of water supply valve 200 to switch from the first pattern to the second pattern.

Referring to FIG. 8, a control method of the fabric treatment apparatus according to an embodiment of the present invention may include a preheating step (S810), a step (S820) of operating water supply valve 200 in a first pattern, a step (S830) of operating water supply valve 200 in a second pattern, and a completing step (S840).

Preheating step (S810) is a step of increasing the temperature in the flow channel forming unit 160. Steam generation heater 130 is operated in a state in which water supply valve 200 is closed. After completion of preheating step (S810), the temperature in flow channel forming unit 160 may be increased at least to the steam generation temperature Ts. When the temperature in flow channel forming unit 160 reaches the steam generation temperature Ts, preheating step (S810) may be completed and then water may be supplied through water supply valve 200.

When the temperature in flow channel forming unit 160 reaches the critical temperature Tc during operation of water supply valve 200 in the first pattern, however, it is not necessary to immediately switch the operating pattern of water supply valve 200 from the first pattern to the second pattern. When the temperature sensed by temperature sensing unit 210 reaches the critical temperature Tc during execution of step S820, controller 230 may control the operation of steam generation heater 130 to be stopped. As the operation of steam generation heater 130 is stopped, the temperature in flow channel forming unit 160 is gradually decreased. When the temperature in the flow channel forming unit 160 reaches the steam generation temperature Ts, controller 230 may control the operation of steam generation heater 130 to be resumed. That is, steam generation heater 130 is repeatedly operated and stopped by the controller 230 based on the temperature sensed by temperature sensing unit 210 such that the temperature in flow channel forming unit 160 can be adjusted between the steam generation temperature Ts and the critical temperature Tc.

Furthermore, at step S820, the number of times the temperature sensing unit 210 senses the temperature higher than the critical temperature Tc (or the number of times of operating the steam generation heater 130) may be accumulated. When the accumulated number of times reaches a predetermined value, controller 230 may control the water supply valve 200 to be operated according to the second pattern.

Meanwhile, in a case in which scale is formed in flow channel forming unit 160 or in nozzle 170, water may not smoothly flow in flow channel forming unit 160 with the result that the interior of flow channel forming unit 160 may be overheated. Additionally, in a case in which water is directly supplied to the flow channel forming unit 160 from an external water source, such as a tap, a sufficient amount of steam may not be sprayed through the nozzle and the interior of flow channel forming unit 160 may be overheated if water pressure of the water supplied from the external water source is low. In the control method of the fabric treatment apparatus according to the embodiment of the present invention, the operation pattern of water supply valve 200 switches from the first pattern to the second pattern based on the temperature in flow channel forming unit 160. Consequently, it is possible to prevent the temperature in flow channel forming unit 160 from being excessively increased although the above causes occur.

Meanwhile, when the temperature in flow channel forming unit 160 is not decreased to or below the critical temperature Tc, even though, controller 230 controls water supply valve 200 to be operated in the second pattern for a predetermined time, controller 230 may control the operation of steam generation heater 130 to be stopped.

Controller 230 may recognize temperature change as well as the current temperature based on the information received from the temperature sensing unit. For example, in a case in which the temperature of flow channel forming unit 160 is decreased after the second pattern is applied, the second pattern may be continuously applied. On the other hand, in a case in which the temperature of flow channel forming unit 160 is increased even after the second pattern is applied, the third pattern may be applied. In the third pattern, the supply amount of water per unit time is greater than in the second pattern.

In a case in which the temperature of the flow channel forming unit 160 is increased even after the second pattern or the third pattern is applied, controller 230 may control the driving of steam generation heater 130 to be stopped. Controller 230 may control a warning display unit 240 to display that flow channel of the flow channel forming unit 160 has been closed.

Water supply valve 200 according to the embodiment of the present invention may be a reducing valve configured such that the pressure of water introduced into the valve is lower than the pressure of water discharged from the valve.

Water flows from the water receiving unit 72 to the water supply valve 200 via the pump 73. The pump 73 forcibly feeds water to the water supply valve 200. The water supply valve 200 controls water flowing to the introduction port 140. A predetermined period of time is required until water introduced into the flow channel forming unit 160 is phase-changed into steam. The water supply valve 200 may be a reducing valve. The reducing valve reduces the pressure of water introduced into the reducing valve and supplies the decompressed water to the introduction port 140. The reducing valve reduces the pressure of water or maintains the water in a predetermined pressure using pressure applied to a bellows and a diaphragm and balance of a spring.

Figure 10:
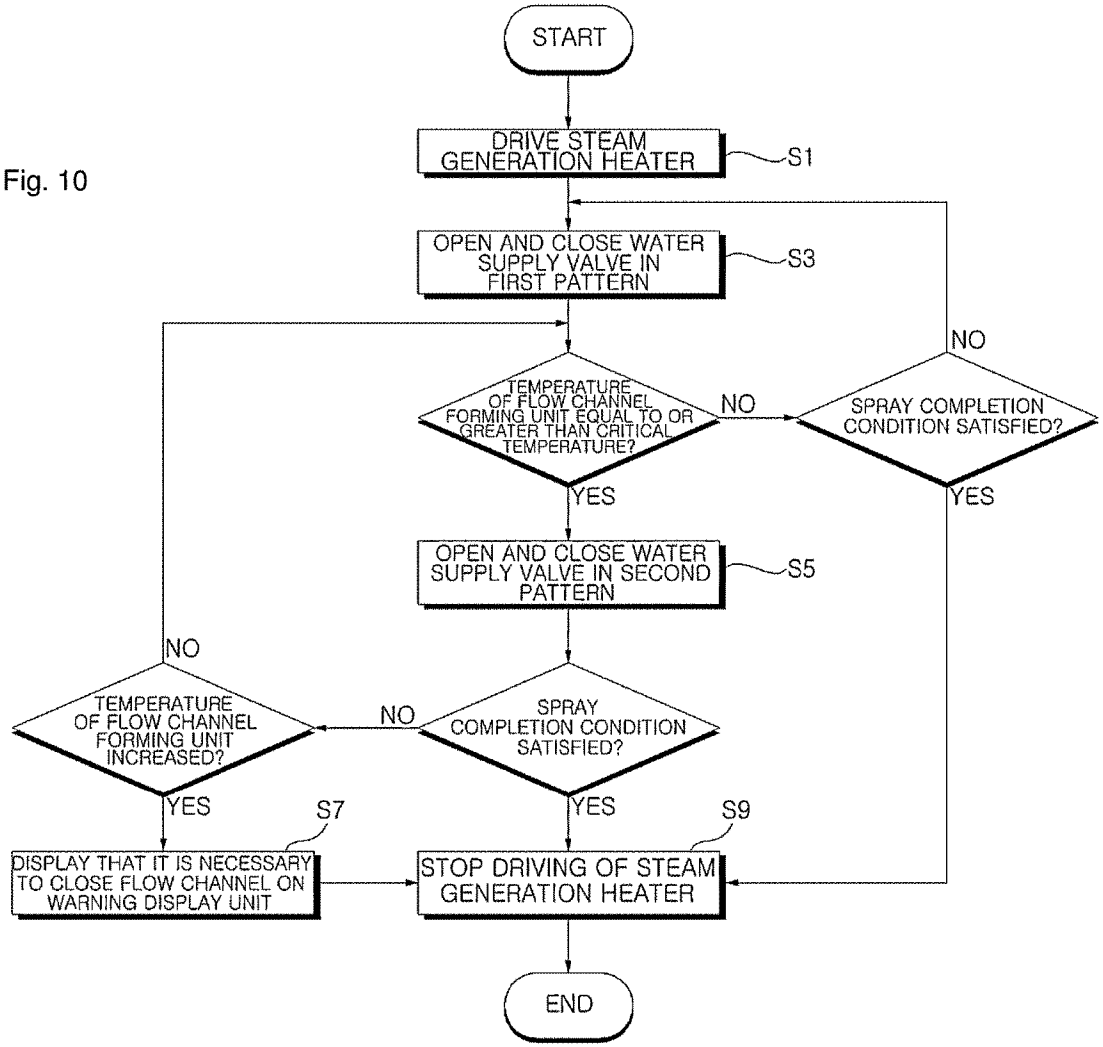
FIG. 10 is a flowchart showing a control method of a fabric treatment apparatus according to another embodiment of the present invention.

FIG. 10 is a flowchart showing a control method of a fabric treatment apparatus according to another embodiment of the present invention. Hereinafter, a first pattern and a second pattern of this embodiment correspond to the first pattern and the second pattern of the previous embodiments. Referring to FIGS. 7 to 10, the control method of the fabric treatment apparatus according to the embodiment of the present invention includes a step (S1) of driving the steam generation heater 130, a step (S3) of controlling water supply valve 200 in a first pattern, and a step (S5) of controlling water supply valve 200 in a second pattern configured to supply a larger amount of water than in the first pattern for the same time.

At step S1, steam generation heater 130 is operated in a state in which water supply valve 200 is closed.

Step S3 may be carried out in a case in which the temperature of flow channel forming unit 160 reaches the steam generation temperature Ts. When the temperature of flow channel forming unit 160 sensed by temperature sensing unit 210 reaches the steam generation temperature Ts, controller 230 controls water supply valve 200 to be operated in the first pattern.

When the temperature of flow channel forming unit 160 sensed by temperature sensing unit 210 reaches the critical temperature Tc during execution of step S3, controller 230 controls water supply valve 200 to be operated in the second pattern (S5).

When the temperature in flow channel forming unit 160 is increased even after step S5 is carried out, controller 230 may control warning display unit 240 to display warning (S7). Controller 230 may recognize temperature change as well as the current temperature based on the information received from temperature sensing unit 210. For example, in a case in which the temperature of flow channel forming unit 160 is decreased after the second pattern is applied, the second pattern may be continuously applied. On the other hand, in a case in which the temperature of flow channel forming unit 160 is increased even after the second pattern is applied, the third pattern may be applied. In a case in which the temperature of flow channel forming unit 160 is increased even after the second pattern or the third pattern is applied, controller 230 may control the driving of steam generation heater 130 to be stopped (S9). Additionally, controller 230 may control warning display unit 240 to display that the flow channel of the flow channel forming unit 160 has been closed (S7). A user may recognize that it is necessary to replace or repair the flow channel forming unit 160 through warning display unit 240.

A steam spray completion condition may be a case in which a steam spray course is completed. The steam spray course is carried out for a predetermined time. When the steam spray course is normally completed, controller 230 does not display that the flow channel of the flow channel forming unit 160 has been closed through warning display unit 240 and stops the driving of steam generation heater 130.

The present invention has one or more of the following effects.

First, it is possible to adjust an open time of the water supply valve and thus to prevent overheating of the steam spray device.

Second, it is possible to adjust the amount of steam generated by the steam spray device using one water supply valve.

Third, it is possible to control the spray of steam using the water supply valve and thus to diversify a steam spray pattern.

Fourth, it is possible to adjust an opening degree of the water supply valve and thus to prevent condensed water from being discharged from the nozzle.

It should be noted that effects of the present invention are not limited to the effects of the present invention as mentioned above, and other unmentioned effects of the present invention will be clearly understood by those skilled in the art from the following claims.

Although embodiments have been described herein with reference to a number of illustrative embodiments thereof, it should be understood that numerous other modifications and embodiments can be envisioned by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A control method of a fabric treatment apparatus comprising a steam spray device and a water supply valve, the control method comprising:

a step (a) of controlling, by a controller, the water supply valve to be repeatedly opened and closed according to a first pattern; and a step (b) of controlling, by the controller, the water supply valve to be repeatedly opened and closed according to a second pattern wherein the second pattern supplies a larger amount of water than in the first pattern for the same time period, wherein a second pattern duty cycle of the water supply valve is greater than a first pattern duty cycle of the water supply valve, wherein the control method further comprising:

sensing, by a temperature sensing unit, a temperature in the steam spray device during execution of the step (a), wherein the step (b) is performed when the sensed temperature reaches a predetermined upper limit of temperature, wherein the steam spray device comprises a steam generation heater for heating water, and wherein the control method further comprises:

sensing, by a temperature sensing unit, a temperature in the steam spray device in which the steam is generated during execution of the step (a);

stopping, by the controller, operation of the steam generation heater when the sensed temperature reaches a predetermined upper limit of temperature; and resuming, by the controller, the operation of the steam generation heater when the temperature in the steam spray device is lowered to a predetermined lower limit of temperature in a state in which the operation of the steam generation heater is stopped.

2. The control method of claim 1, wherein a second pattern open time of the water supply valve is longer than a first pattern open time of the water supply valve.

3. The control method of claim 1, wherein the steam spray device comprises a steam generation heater for heating water, and wherein the control method further comprises:

a step (c) of operating, by the controller, the steam generation heater in a state in which the water supply valve is closed, and wherein the step (a) is performed after the step (c).

4. The control method of claim 3, further comprising:

sensing, by a temperature sensing unit, a temperature in the steam spray device during execution of the step (c), wherein the step (a) is performed when the sensed temperature is raised to a predetermined lower limit of temperature.

5. The control method of claim 4, wherein the lower limit of temperature is equal to or higher than a temperature necessary for water to be phase-changed into steam.

6. The control method of claim 1, further comprising:

accumulating, by the controller, the number of times of operating the steam generation heater, wherein the step (b) is carried out when the accumulated number of times reaches a predetermined value.

7. A fabric treatment apparatus comprising:

a fabric receiving unit having a space for receiving fabric formed therein;

a steam spray device for heating water to generate steam and spraying the generated steam into the fabric receiving unit;

a temperature sensing unit for sending a temperature in the steam spray device;

a water supply valve for adjusting water flow to the steam spray device; and a controller for controlling the water supply valve to be repeatedly opened and closed according to a first pattern and then controlling the water supply valve to be repeatedly opened and closed according to a second pattern, wherein the second pattern supplies a larger amount of water than in the first pattern for the same time period, wherein a second pattern duty cycle of the water supply valve is greater than a first pattern duty cycle of the water supply valve, wherein the controller controls operation of the steam generation heater to be stopped when the temperature sensed by the temperature sensing unit reaches a predetermined upper limit of temperature while the water supply valve is operated according to the first pattern, and wherein the controller controls the operation of the steam generation heater to be resumed when the temperature sensed by the temperature sensing unit is lowered to a predetermined lower limit of temperature in a state in which the operation of the steam generation heater is stopped.

8. The fabric treatment apparatus of claim 7, wherein a second pattern open time of the water supply valve is longer than a first pattern open time of the water supply valve.

9. The fabric treatment apparatus of claim 7, wherein the steam spray device comprises:

a flow channel forming unit having a flow channel, along which water introduced through the water supply valve flows, formed therein;

a steam generation heater for heating the water flowing along the flow channel forming unit to generate steam; and a nozzle for spraying the steam generated in the flow channel forming unit into the fabric receiving unit, and wherein the temperature sensing unit senses a temperature in the flow channel forming unit.

10. The fabric treatment apparatus of claim 7, wherein the controller controls the water supply valve to be operated according to the first pattern when the temperature sensed by the temperature sensing unit is raised to a predetermined lower limit of temperature after the steam generation heater is controlled to be operated in a state in which the water supply valve is closed.

11. The fabric treatment apparatus of claim 10, wherein the lower limit of temperature is equal to or higher than a temperature necessary for water to be phase-changed into steam.

12. The fabric treatment apparatus of claim 7, wherein the controller accumulates the number of times of operating the steam generation heater and controls the water supply valve to be operated according to the second pattern when the accumulated number of times reaches a predetermined value.

* * * * *